United States Patent [19]

Dennis et al.

[11] 4,096,464

[45] Jun. 20, 1978

[54] THERMISTOR ASSEMBLY HAVING OVERLOAD PROTECTION

[75] Inventors: Philip J. Dennis, Cape Elizabeth; George H. Simpson, Windham, both of Me.

[73] Assignee: GTE Sylvania Incorporated, Danvers, Mass.

[21] Appl. No.: 750,063

[22] Filed: Dec. 13, 1976

[51] Int. Cl.[2] ..... H01H 85/00

[52] U.S. Cl. ..... 337/5; 337/416; 361/24

[58] Field of Search ..... 337/5, 17, 401, 404, 337/405, 407, 409, 416; 200/61.08; 361/24, 104, 106

[56] References Cited

U.S. PATENT DOCUMENTS

| | | | |
|---|---|---|---|
| 3,827,014 | 7/1974 | Wehl | 337/407 |
| 3,995,246 | 11/1976 | Morgan | 337/404 |

*Primary Examiner*—George Harris
*Attorney, Agent, or Firm*—James Theodosopoulos

[57] ABSTRACT

A disc type thermistor has a low melting point metal rod disposed between the thermistor and a metal spring. The spring places the rod in compressive contact with one surface of the thermistor. When the thermistor overheats, the rod melts and opens the circuit.

2 Claims, 2 Drawing Figures

THERMISTOR ASSEMBLY HAVING OVERLOAD PROTECTION

THE INVENTION

The purpose of this invention is to provide a thermistor assembly having overload protection so as to prevent overheating due to excess voltage or excessive ambient temperatures. The protection is provided by means of a low melting point metal rod in contact with one surface of the thermistor and through which the thermistor current flows.

Figure 1:
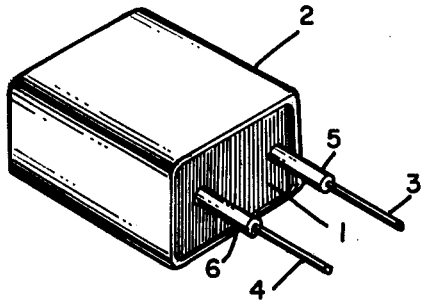
FIG. 1 is a perspective view of an enclosed thermistor assembly.
Figure 2:
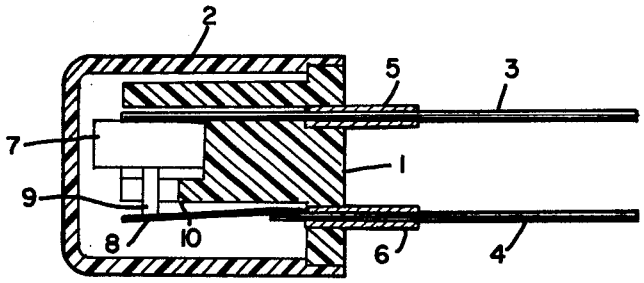
FIG. 2 is a cross-sectional view thereof.

The assembly is mounted on plastic base 1 and is enclosed within plastic cover 2. Extending through holes in base 1 are lead-in wires 3 and 4, which are fastened to metal sleeves 5 and 6 through which they extend. Sleeves 5 and 6 are fixedly attached to base 1 at the time of molding base 1. The inner end of lead-in wire 3 is electrically connected, e.g., soldered, to one face of disc-shaped thermistor 7. Electrical connection from lead-in wire 4 to the other face of thermistor 7 is established through a flat metal spring 8, made, for example, of beryllium copper or phosphor bronze, fastened to the inner end of lead-in wire 4 and thence through low melting point metal rod 9. The action of spring 8 places rod 9 in compression between spring 8 and thermistor 7. In one example, rod 9 was 72 mils diameter by 170 mils long and consisted of 60% tin - 40% lead solder having a melting point of 369° F. Rod 9 was fastened to spring 8 and to thermistor 7 by, for example, soldering.

In normal operation of the device, voltage applied to leads 3 and 4 will cause thermistor 7 to conduct. As the temperature of thermistor 7 increases due to $I^2R$ heating or to an increase in ambient temperature, a temperature will be reached which will cause a sudden increase in resistance in thermistor 7 which will effectively reduce the current passing through the device by about 99%. Under normal circumstances, the thermistor will not overheat and the system will remain at some equilibrium temperature and will continue to impede the passage of current. However, if for some reason excessive voltage is applied, the device will overheat and could constitute a fire hazard. In this invention, the overheating will cause rod 9 to melt. Spring 8 will continue to force rod 9 against thermistor 7 until spring 8 is stopped by surface 10 of base 1. About this time all or most of the low melting point metal of rod 9 will have melted and flowed across the surface of thermistor 7. The metal will flow on thermistor 7 rather than on spring 8 because thermistor 7 is the source of heat which is melting the metal. The metal of rod 9 is constantly forced against thermistor 7 by the pressure of spring 8 until surface 10 stops spring 8 and open circuit occurs.

We claim:

1. A thermistor assembly comprising a base, a disc thermistor supported on said base, a lead-in wire electrically connected to one surface of the thermistor, an electrical connection from the second thermistor surface to a second lead-in wire comprising a low melting point metal rod placed in compressive electrical contact with the second surface by a flat metal spring connected to the second lead-in wire, and a stop on the base to prevent the spring from contacting the thermistor when the rod has melted, the thermistor providing normal electrical protection and the low melting point metal rod providing thermal overload protection, the melting temperature of the low melting point metal rod being higher than the temperature at which the thermistor undergoes sudden increase in resistance.

2. The thermistor assembly of claim 1 wherein the rod composition is 60% tin - 40% lead.

* * * * *